United States Patent [19]

Dodane

[11] 4,445,783

[45] May 1, 1984

[54] SYSTEM FOR THE CONTROL OF A WHEEL FOR DRIVING IN ROTATION A CHRONOGRAPH HAND

[75] Inventor: Raymond Dodane, Besancon, France

[73] Assignee: Montres Dodane-Precia-Gete, France

[21] Appl. No.: 370,259

[22] Filed: Apr. 20, 1982

[30] Foreign Application Priority Data

Apr. 23, 1981 [FR] France ..... 81 08116

[51] Int. Cl.[3] ..... G04F 3/00

[52] U.S. Cl. ..... 368/105; 368/106

[58] Field of Search ..... 368/101–106

[56] References Cited

U.S. PATENT DOCUMENTS 278,127 5/1983 Goy ..... 368/103

3,045,418 7/1962 Heuer ..... 368/106

*Primary Examiner*—Bernard Roskoski

*Attorney, Agent, or Firm*—Steinberg & Raskin

[57] ABSTRACT

A system for the control of a wheel for driving a chronograph hand in rotation comprising a device for locking the hand-wheel, which includes a locking shoe mounted on a support connected to the return-to-zero lever and to the coupling rocker, so that the movement of the hand-wheel away from the rocker and the lever results in a movement of the locking shoe towards the hand-wheel and in their mutual engagement.

6 Claims, 5 Drawing Figures

SYSTEM FOR THE CONTROL OF A WHEEL FOR DRIVING IN ROTATION A CHRONOGRAPH HAND

BACKGROUND OF THE INVENTION

The present invention relates to a system for the control of a wheel for driving in rotation a chronograph hand, comprising a lever for returning the hand to zero and the associated wheel, a rocker for coupling the hand wheel to an intermediate wheel and a column wheel for the control of the said lever and the said rocker.

The known chronograph control systems suffer from the drawback that they are not adapted to prevent a lateral shock or vibrations from causing the rotation of the hand when the latter is at a stop and in a position other than its returned-to-zero position. Now the angular position of the hand represents an information which, therefore, may be lost as a result of such a shock or vibrations.

SUMMARY OF THE INVENTION

The purpose of the present invention is to remedy this drawback of the known chronograph control devices.

In order to achieve this aim, the control system according to the invention includes a hand wheel locking device which is provided with a locking shoe mounted on a support connected to the return-to-zero lever and to the coupling rocker, so that the movement of the hand wheel from the said rocker and the said lever results in a movement of the shoe towards the hand wheel and its engagement therewith.

According to an advantageous characterizing feature of the invention, the shoe support is constituted by a strip spring connected at one end to the coupling rocker and at its other end to the return-to-zero lever.

According to another advantageous characterizing feature of the invention, the locking shoe is provided on its face intended to engage with the hand wheel with gear teeth complementary to those of the said hand wheel or is constituted by a natural or synthetic rubber block.

DETAILED DESCRIPTION OF THE DRAWINGS

Figure 1:
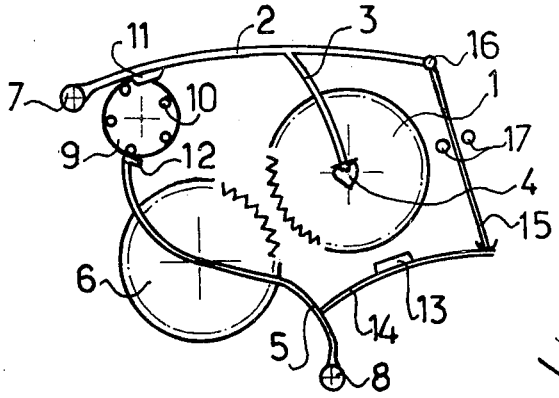
Figure 4:
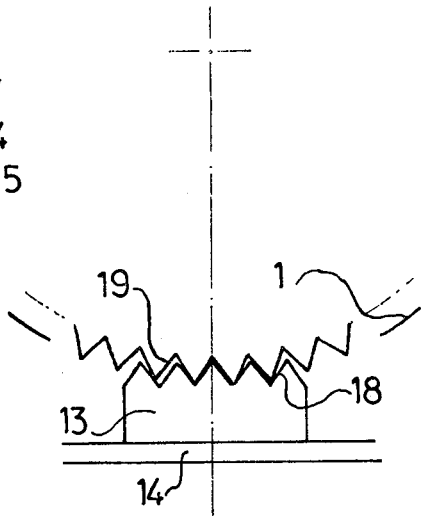
Figure 2:
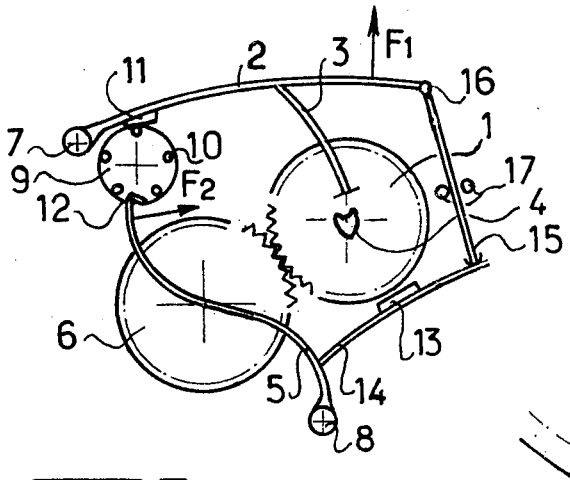
Figure 5:
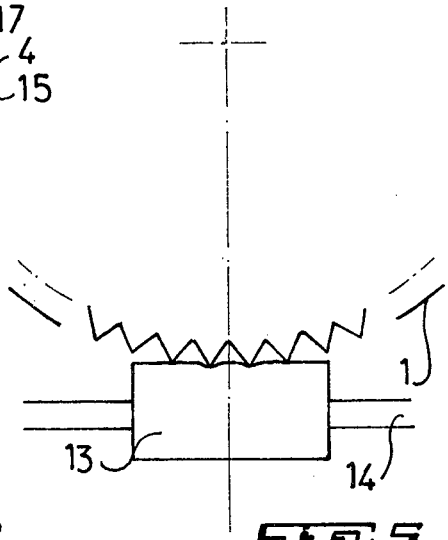
Figure 3:
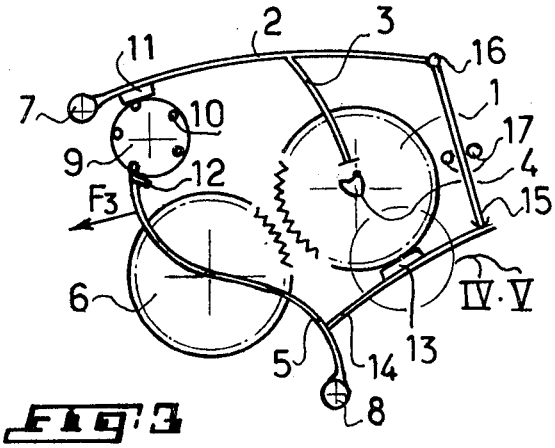

The invention will be better understood and other purposes, characterizing features, details and advantages of the latter will appear more clearly from the following explanatory description made with reference to the appended diagrammatic drawings given solely by way of example illustrating one form of embodiment of the invention and wherein:

FIGS. 1 to 3 are diagrammatic views of the control system according to the invention and represent the said system in three different positions, and FIGS. 4 and 5 show diagrammatically and to a larger scale two forms of embodiment of the control system portion surrounded in FIG. 3 by a circle denoted by IV and V, respectively.

DESCRIPTION OF THE PREFERRED EMBODIMENTS

FIGS. 1 to 3 show a system for the control of a wheel 1 for driving in rotation a chronograph hand, not shown. In the example illustrated, the said driving wheel is the seconds-wheel of a chronograph. The control system includes a lever 2 for returning to zero the seconds-wheel 1 which is equipped with a return-to-zero hammer 3 intended to co-operate, in a manner known per se, with a heart-shaped cam 4 jointly movable in rotation with the seconds-wheel 1. The control system also includes a rocker 5 for coupling an intermediate wheel 6 with the hand wheel 1. The intermediate wheel 6 is rotatably mounted on the rocker 5.

The return-to-zero lever 2 and the coupling rocker 5 are mounted at 7 and 8, respectively, so as to be pivotally movable under the action of a column wheel 9 provided for example with five columns 10. The lever 2 is provided with a cam 11 upon which acts the column wheel 9. The free end of the coupling rocker also is cam-shaped as shown diagrammatically at 12 to allow the rocker to co-operate with the column wheel 9.

The control system according to the invention also comprises a device for locking the seconds-wheel 1. This device includes essentially a locking shoe 13 secured to the medial portion of a support arm 14 in the form of a strip-spring. The latter is secured at one end to the coupling rocker 5 and bears with its other end upon the free end of a releasing lever 15 pivotally connected at its opposite end at 16 to the end of the return-to-zero arm 2. The releasing lever 15 is guided between two pins 17.

The strip-spring 14 preferably extends substantially perpendicularly to the rocker 5 and the lever 15. In conjunction with the latter and with the return-to-zero lever 2, it defines a space in which the seconds-wheel 1 is located. Thus, any movement of this wheel from the lever 2 and the rocker 5 results in a movement of the locking shoe 13 towards the seconds-wheel 1. It should be noted that the strip-spring 14 is constantly maintained by the releasing lever 15 in a pre-stressed condition.

FIGS. 4 and 5 illustrate two forms of embodiment of the locking shoe 13. According to FIG. 4, the shoe 13 is provided with gear teeth 18 complementary to the gear teeth 19 of the seconds-wheel 1. In the wheel locking position, the two gears are in mesh with one another. In the form of embodiment according to FIG. 5, the locking shoe 13 is constituted by a natural or synthetic rubber block.

The operation of the control system according to the invention appears from FIGS. 1 to 3 which show this device in three significant positions.

FIG. 1 shows the system in the returned-to-zero position of the chronograph. The return-to-zero hammer 3 is in engagement with the heart-shaped cam 4 and locks the seconds-wheel 1 in its position 0. In this position of the seconds-wheel 1, the hand (not shown) of the chronograph is at zero on the indicating dial. The cam 12 at the end of the coupling rocker 5 is in engagement with a column 10 of the column wheel 9 and in its moved-away position with respect to the seconds-wheel 1, in which the intermediate wheel 6 is disengaged or uncoupled from the seconds-wheel. The cam 11 of the return-to-zero lever 2 being located between two columns 10 of the column wheel 9, the releasing lever 15 maintains the strip-spring arm 14 in a position where the shoe 13 is furthest from the periphery of the seconds-wheel 1.

FIG. 2 shows the system according to the invention in the position where the seconds-wheel 1 is coupled with the intermediate wheel 6. With respect to the position shown in FIG. 1, the column wheel 9 has rotated by one-third of a pitch. Since the cam 11 of the return-to-zero lever 2 was on the path of a column 10, it has been shifted by the latter so that the lever 2 has effected a pivoting movement in the direction of arrow F1. This pivoting movement of the lever 2 has allowed the locking shoe 13 to move nearer to the periphery of the seconds-wheel 1, since the backward movement of the bearing end of the releasing lever 15 has allowed the strip-spring 14 represented in FIG. 1 in a relatively considerably bent position to unbend a little. But the locking shoe 13 is still not in engagement with the periphery of the seconds-wheel 1 because the rotation of the column wheel 9 had released the end cam 12 of the coupling rocker 5. This has allowed the rocker to slightly rotate in the direction of arrow F2, thus moving the intermediate wheel 6 into engagement with the seconds-wheel 1.

FIG. 3 shows the system according to the invention in the seconds-wheel locking position. In this position, the locking shoe 13 bears upon the periphery of the seconds wheel. With respect to FIG. 2, the column wheel 9 has rotated by one-third of a pitch. The cam 11 still bearing upon a column 10 of the wheel 9, the angular position of the return-to-zero lever 2 is practically the same as that shown in FIG. 2. On the other hand, the coupling rocker 5 has been shifted in the direction of arrow F3 because its end cam 12 was on the path of a column 10 of the wheel 9 and has been drawn along by the latter. This pivotal movement of the rocker 5 in the direction of arrow F3 has resulted in the disengagement of the seconds-wheel 1 and the intermediate wheel 6 from one another and has allowed the locking shoe to move nearer the seconds-wheel 1 and into engagement therewith.

It should be noted that many modifications may be made in the invention without departing from the scope thereof. Thus, it is possible to replace the strip-spring 14 by a rigid element which, in this case, would be pivotally connected with the releasing lever 15. The locking shoe may be shaped otherwise and made from another material. It is only important that its engagement with the second wheel results in the locking of the latter. It is obvious that the invention may be applied to any other hand-driving wheel and is not limited to the application to a seconds-wheel.

More generally, the invention is by no means limited to the form of embodiment described and illustrated which has been given by way of example only. In particular, it comprises all means constituting technical equivalents to the means described as well as their combinations should the latter be carried out according to its gist and used within the scope of protection claimed.

What is claimed is:

1. A system for the control of a wheel for driving in rotation a chronograph hand, comprising a pivotally mounted lever for returning the hand wheel to zero and including a return-to-zero hammer adapted to co-operate with a heart-shaped cam jointly movable in rotation with the hand wheel, a pivotally mounted rocker for coupling an intermediate wheel rotatably mounted thereon with said hand wheel, a rotatable column wheel for controlling said lever and said rocker and a device for locking said hand wheel when said column wheel has rotated over a certain angle, wherein said locking device includes a locking shoe mounted on a support constituted by an arm attached at one end to the coupling rocker and connected at its other end to the return-to-zero lever by a releasing lever, so that the engagement of the locking shoe with the hand wheel results from the simultaneous movement of the rocker and the return-to-zero lever away from the hand wheel when said column wheel has rotated over said certain angle.

2. A system according to claim 1, wherein the support arm of the locking shoe is constituted by a strip-spring bearing by its free end upon the end of the releasing lever while maintained in a pre-stressed condition by the latter.

3. A system according to claim 1, wherein the releasing lever is pivotally connected to the return-to-zero lever and is guided by guiding pins.

4. A system according to claim 1, wherein the support arm extends substantially perpendicularly to the coupling rocker and to the releasing lever and defines with the latter and with the return-to-zero lever a space in which the hand wheel is located.

5. A system according to claim 1, wherein the locking shoe comprises gear teeth complementary to those of the hand wheel, the two gears being in mesh with one another in the hand wheel locking position.

6. A system according to claim 1, wherein the locking shoe is constituted by a natural or synthetic rubber block.

* * * * *